US005490544A

United States Patent [19]

Broline

[11] Patent Number: 5,490,544

[45] Date of Patent: Feb. 13, 1996

[54] METHOD AND APPARATUS FOR INHIBITING AIR INFILTRATION INTO FUEL DISPENSING LINES

[75] Inventor: Russell L. Broline, Milan, Ill.

[73] Assignee: The Marley Pump Company, Mission, Kans.

[21] Appl. No.: 280,724

[22] Filed: Jul. 26, 1994

[51] Int. Cl.[6] ..... B65B 1/04; B65B 3/04

[52] U.S. Cl. ..... 141/1; 141/14; 141/39; 141/45; 141/47; 141/192; 141/230; 137/202; 137/587

[58] Field of Search ..... 141/1, 4, 14, 15, 141/37, 39, 40, 44, 45, 47, 59, 95, 192, 230; 137/587, 142, 202; 73/40.5 R; 222/55, 61; 138/26, 30

[56] References Cited

U.S. PATENT DOCUMENTS 2,964,918 12/1960 Hansen et al. ..... 141/4

5,038,838 8/1991 Bergamini et al. ..... 141/59

5,368,001 11/1994 Roche ..... 137/587

*Primary Examiner*—Henry J. Recla

*Assistant Examiner*—Timothy L. Maust

*Attorney, Agent, or Firm*—Kokjer, Kircher, Bowman & Johnson

[57] ABSTRACT

A device used in liquid fuel dispensing systems to inhibit the infiltration of air into the product dispensing line due to thermal contraction. A fluid tight container is connected with the product line and supplied with fuel in an amount sufficient to make up the liquid volume loss caused by thermal contraction. A siphon line in the container opens near its bottom. A vent for the container is normally closed by a valve under normal pressures of the dispensing system. When thermal contraction reduces the product line pressure far enough to create a vacuum, the valve opens the container vent so that the fuel in the container can flow into the product line to keep it full of liquid and avoid drawing air into the line.

19 Claims, 2 Drawing Sheets

METHOD AND APPARATUS FOR INHIBITING AIR INFILTRATION INTO FUEL DISPENSING LINES

FIELD OF THE INVENTION

This invention relates generally to systems for dispensing fuel and more particularly to an arrangement for inhibiting air infiltration into the product line through which the fuel is pumped to the dispensing unit of a service station or other facility.

BACKGROUND OF THE INVENTION

Automotive fuel is normally stored at gasoline service stations in large underground tanks. Product lines extend from the tanks to dispensing units which are typically pedestals equipped with dispensing nozzles. A submersible pump delivers the fuel through the product line to the dispenser when a switch at the pedestal is activated to energize the pump. The product line has a check valve so that the product line remains full of fuel at the end of each dispensing cycle. This allows the fuel to be dispensed immediately at the start of the next dispensing cycle. A pressure relief valve relieves the pressure in the product line so that it is maintained at a selected level (typically about 15 psi) at the end of each dispensing cycle. The product line is normally equipped with a leak detector which operates to detect the leakage of fuel from the product line and to close the product line in the event of undue leakage.

While fuel dispensing systems of this type work well for the most part, thermal effects can cause problems. For example, when a service station closes for the night, the fuel in the product line is at approximately the same relatively warm temperature as the fuel in the storage tank. However, the ground temperature around the underground product line can be significantly colder. As a result, the fuel in the product line is cooled and eventually drops to the ground temperature which can involve a temperature drop of 30° F. or more.

As the fuel cools, it thermally contracts and the liquid volume in the product line decreases. The line pressure can in many cases drop below 0 psig, and the vacuum that results causes air infiltration into the product line piping through joints and seals that are not designed to hold a vacuum. The leak detector closes the product line due to the loss of line pressure.

The following morning when the station is opened, a leak check is performed when the pump is started. However, the air that is in the line must be compressed in order to bring the line pressure up to the level needed to open the leak detector valve element. In order to compress the air sufficiently for the leak detector to open, it can require up to ten times the amount of fluid downstream from the leak detector that is required in the absence of air in the line. Consequently, a normal three second leak check can take up to 30 seconds. A customer attempting to dispense fuel during this 30 second period will be unable to do so, as the leak detector interprets the open dispensing nozzle as a leak and remains closed so that the fuel cannot flow to the dispenser.

Although thermal contraction occurs throughout the day in cold climates, it is normally not a problem other than for overnight periods. If the station is busy during the day, the time between successive dispensing cycles is not long enough that thermal contraction can occur to the extent required to create a vacuum. However, premium fuels and other less popular fuels can be dispensed so infrequently that a vacuum can be established and air can enter the product line and create problems even in daytime hours.

SUMMARY OF THE INVENTION

It is thus evident that a need exists for reducing the air infiltration into fuel dispensing lines caused by the effects of thermal contraction. It is the principal goal of the present invention to meet that need.

More specifically, it is an object of the invention to provide a source of make up fuel which is automatically delivered into the product line when vacuum conditions are created by thermal contraction of the fuel, while avoiding any adverse effects on the normal operation of the fuel dispensing equipment.

In accordance with the invention, a fluid tight container holds enough fuel to make up the amount of volume loss in the product line that is expected to occur due to thermal contraction at the locale of the fuel dispensing system. The container provides a fuel reservoir which has a port connected with the product line through a siphon line. A vent for the reservoir is connected with the interior of the underground storage tank. The vent is controlled by a pressure responsive valve which maintains the vent closed under normal operating conditions of the dispensing system. Consequently, when the system is operating at normal pressure conditions, the fuel remains in the reservoir. However, if the pressure in the product line drops to a predetermined level (0 psig for example), the valve opens to allow incoming air to displace the fuel in the reservoir so that it can flow into the product line to make up for the volume loss caused by thermal contraction of the fuel in the product line. This assures that the product line remains full of liquid and free of significant amounts of air.

When the pump is energized, the leak detector performs its line check in the normal fashion (taking approximately three seconds or even less time). Operation of the pump also pumps fuel back into the reservoir through the siphon line, and the valve remains open so that air in the reservoir can be displaced through the vent. When the reservoir has been restored to a full condition, the valve closes and remains closed until the line pressure drops again to 0 psig or another selected low level.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
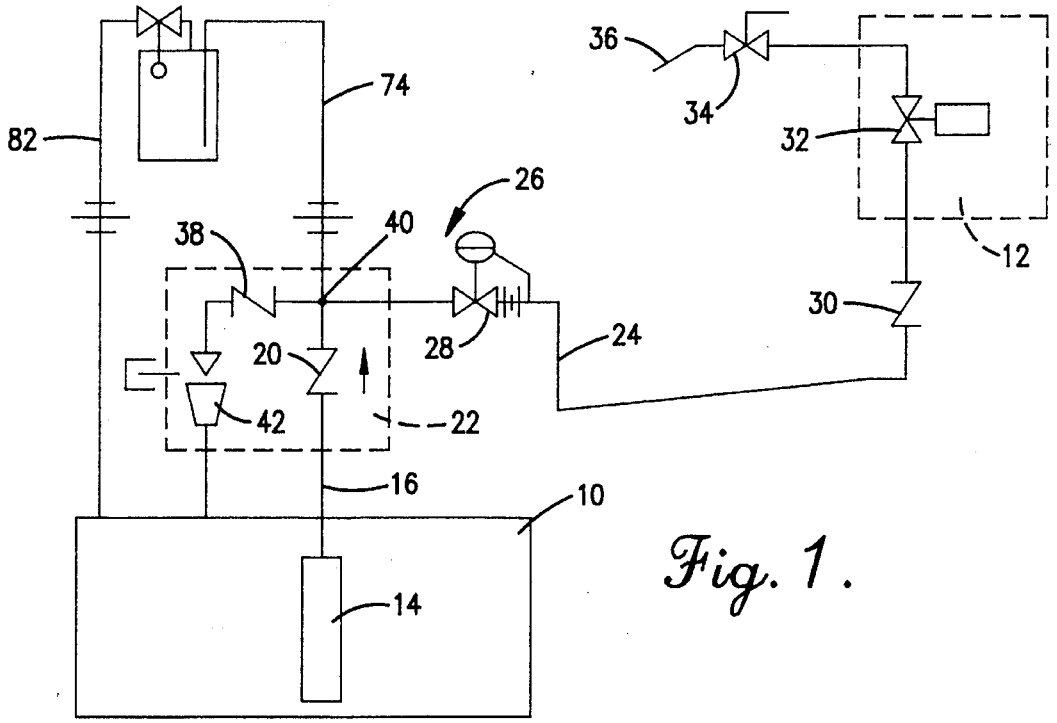
FIG. 1 is a schematic diagram of a fuel dispensing system which is equipped with a device for inhibiting air infiltration in accordance with a preferred embodiment of the present invention.

Referring now to the drawings in more detail and initially to FIG. 1, the present invention is used in a fuel dispensing system which includes an underground tank 10 of the type commonly installed at gasoline service stations. The tank 10 holds gasoline which is pumped from the tank to an above ground dispenser generally identified by numeral 12. A submersible pump 14 is located in the tank 10 and pumps the fuel into a discharge line 16 which forms part of the product line which delivers fuel to the dispenser 12. Line 16 is provided with a check valve 20 which is located within a packer 22. The check valve 20 allows the fuel to flow through line 16 away from pump 14 but not back toward the pump. Downstream from the check valve 20, a dispensing line 24 connects with line 16. Line 24 is an underground line which serves as the product line for the dispensing system. A conventional mechanical leak detector 26 is provided in line 24 near its upstream end. The leak detector 26 has a valve 28 which is closed when a leak is detected in the product line. The leak detector operates in a conventional manner that is well known to those having ordinary skill in the art.

The dispensing line 24 connects through a shear valve 30 with the dispenser 12. The dispensing line 24 supplies fluid through a solenoid valve 32 located in the dispenser 12 and controlled by a conventional switch on the dispenser which is typically a pedestal unit. Downstream from valve 32, a manually operated dispenser valve 34 is provided to control the flow of fluid to a conventional dispensing nozzle 36.

Within the packer, a pressure relief valve 38 is connected to the junction 40 between lines 16 and 24. The opposite side of the relief valve 38 is connected with the interior of the storage tank 10 through a siphon system 42. The pressure within the storage tank 10 is substantially equal to atmospheric pressure. The relief valve 38 is typically set at approximately 15 psig so that at the end of each dispensing cycle when pump 14 is deactivated, the pressure in the dispensing line 24 is reduced to the level of the setting of valve 38.

As thus far described, the fuel dispensing system is conventional and typical of the systems commonly used for gasoline service stations.

Figure 2:
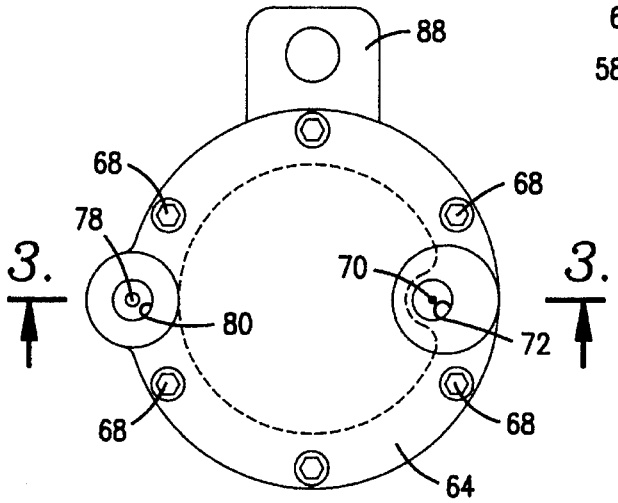
FIG. 2 is a top plan view of a preferred embodiment of the device of the present invention.
Figure 3:
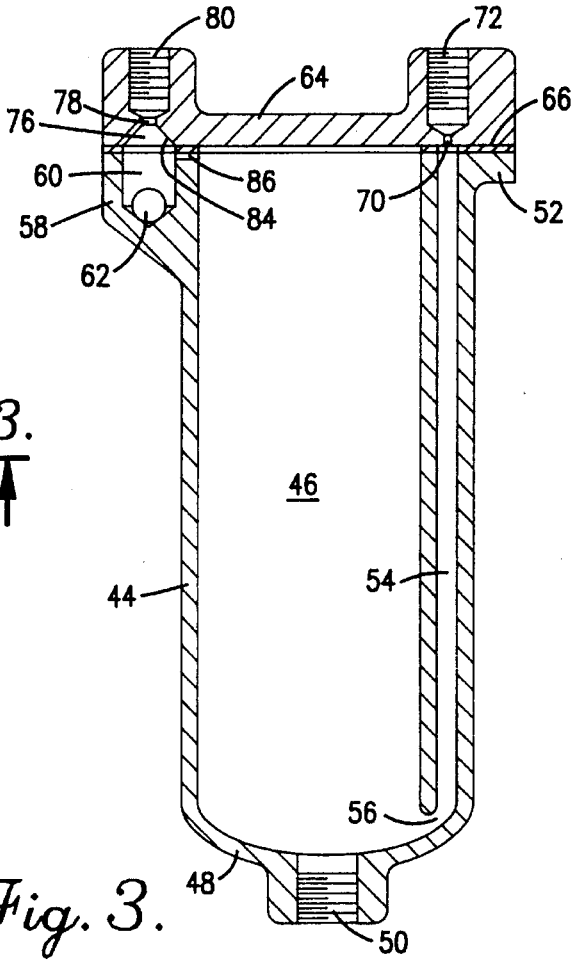
FIG. 3 is a sectional view taken generally along line 3—3 of FIG. 2 in the direction of the arrows.

Referring now to FIGS. 2 and 3 in particular, the present invention provides a substantially fluid tight container 44 which is generally cylindrical in shape and which presents within it a reservoir 46 for holding a quantity of make up fuel, as will be explained more fully, The container 44 has a curved bottom 48 which is equipped with a threaded port 50 normally closed by a suitable plug (not shown). The container 44 is open at the top and is equipped on its upper rim with an out turned flange 52. Extending vertically along one side of the wall of container 44 is a siphon line 54 which connects with the reservoir 46 through a port 56 located adjacent to the container bottom 48.

At a location substantially diametrically opposed from the siphon line 54, the top rim of the container 44 is provided with an enlarged boss 58. An open topped valve chamber 60 is provided within the boss 58. A ball 62 which functions as a valve element is located in the valve chamber 60.

The container 44 is covered at the top by a generally circular lid 64. A gasket 66 is fitted on top of the flange 52 and is compressed between the flange and the lid 64. A plurality of cap screws 68 (see FIG. 2) or other suitable fasteners are used to secure the lid 64 on top of the container 44.

The lid 64 presents an orifice 70 which is aligned with the top end of the siphon line 54 when the lid is in place. The top end of the orifice 70 connects with an internally threaded passage 72. The passage 72 receives a fitting (not shown) which is used to connect the siphon line 54 with tubing 74 (see FIG. 1) which connects at its opposite end with the junction 40. The passage 72 may be provided with a sintered element if desired.

The lid 64 presents a tapered opening 76 which aligns with the valve chamber 60°. A vent port 78 connects with the opening 76 and with a threaded passage 80. A suitable fitting (not shown) is connected with the passage 80 and connects with suitable tubing 82 (FIG. 1) which extends to the interior of the storage tank 10. The tapered opening 76 provides a valve seat 84 against which the ball 62 may seat in a manner to close the vent 78 and thus prevent the flow of air through the vent to or from the reservoir 46. A small passage 86 at the extreme top end of the container 44 provides communication between the top of the reservoir 46 and the valve chamber 60.

As best shown in FIG. 2, one side of the container 44 is provided with a mounting bracket 88. The mounting bracket 88 is used for the mounting of the container 44 to the packer 22 at a suitable elevation.

In operation, the fuel dispensing system dispenses fuel under the control of the user. The solenoid valve 32 is opened at the pedestal switch to energize the pump 14, and fuel is dispensed through the nozzle 36 when the dispenser valve 34 is opened. At the end of the dispensing cycle, the dispenser valve 34 is closed and the solenoid valve 32 is closed to deenergize the pump 14. At the end of the dispensing cycle, the dispensing line 24 remains full of fuel because the check valve 20 prevents the back flow of fuel from the line to the tank. The pump discharge pressure is normally somewhat higher than the setting of the relief valve 38 (which is typically set at about 15 psig). However, liquid from the line 24 is relieved through the valve 38 until the line pressure has been reduced to the setting of valve 38. The dispensing line 24 is maintained full of fuel at this pressure so that dispensing will begin immediately for the next user.

The fuel that is in the dispensing line 24 is initially at approximately the same relatively warm temperature as the fuel in the tank 10. However, when the station is closed overnight, the fuel in the dispensing line 24 can cool considerably if the ground surrounding the line is relatively cold. It is not uncommon for a 30° F. temperature differential to exist between the ground around line 24 and the fuel located within the line. Eventually, this cooling of the fuel results in thermal contraction which reduces the volume of the fuel in the line.

In the absence of the container 44 and related components provided by the present invention, the volume decrease in line 24 would create a vacuum, and air would infiltrate the line through joints and seals that are not designed to hold a vacuum. The loss of line pressure would result in closing of the valve 28 of the leak detector 26. When the pump 14 is energized again the next morning when the station opens again, the line pressure must be raised to that required to open the valve 28. Because of the presence of a considerable volume of air in line 24 downstream from the leak detector 26, it is necessary to compress the air before the pressure can be raised enough to open valve 28. Consequently, considerably more fuel must be pumped into the product line to reach the opening pressure for the leak detector than is required under normal conditions where air has not infiltrated the product line. The result is that it can take up to ten times as much fuel in the product line and ten times as long to complete the leak test than is normal. A normal leak check takes approximately three seconds. In comparison, if the product line fuel drops approximately 30° F. in temperature, the leak test can take ten times as long or approximately 30 seconds. If a customer should attempt to dispense fuel during the 30 second period, the leak detector valve 28 will close again, as the leak detector interprets opening of the nozzle as a leak.

This problem is overcome by the device of the present invention. The reservoir 46 is initially filled to its top, and the volume of fuel contained within the reservoir 46 is selected to be sufficient to make up for the volume reduction in the product line due to the maximum thermal contraction that is expected. The pressure in line 24 is transmitted through the tubing 74 and the product line 54 to the reservoir 46 and through passage 86 to the valve chamber 60. Thus, when the product line 24 is operated under normal pressure conditions (approximately 15 psig and above), valve 62 is maintained in a closed position against the seat 84, and the vent 78 is then closed.

However, if the fuel in line 24 should undergo sufficient thermal contraction to drop the line pressure to approximately 0 psig, the differential pressure across the ball 62 is zero, and the ball 62 drops away from the seat 84, thus opening the vent 78. The vacuum condition in the line 24 draws the fuel out of the reservoir 46 through the port 56, siphon line 54 and tubing 74 such that the make up fuel in the reservoir keeps the product line full of fuel. Because the vent 78 is open and is connected with the atmospheric pressure in the tank 10, air is able to flow into the top of the reservoir through the vent 78 in order to displace the liquid fuel that is drawn out of the reservoir and into the product line.

In this manner, the product line is maintained full of fuel even under the most severe thermal contraction that takes place. Consequently, air is unable to infiltrate into the line 24. When the pump is started the next morning (or at some other time at the end of the thermal contraction), the leak detector 26 performs its leak check in the normal three seconds or so. Starting of the pump also causes fuel to be pumped into reservoir 46 through the tubing 74 and the siphon line 54. When the liquid level in the reservoir 46 has been restored to the level of the passage 86 at the top of the container 44, the valve ball 62 is exposed to the pump discharge pressure and is forced against its seat 84 in order to close the vent 78. In this manner, the reservoir 46 is filled again upon initial energization of the pump following thermal contraction in the product line.

When the pump is deactivated during normal operating conditions, the line pressure is relieved to approximately 15 psig through the relief valve 38. The ball 62 remains closed against seat 84 in order to maintain the pressure in the reservoir 46 at the same level as the product line. The orifice 70 and sintered element if provided restrict the flow rate into container 44 to prevent foaming of the liquid and possible premature closure of the ball 62. Preferably, the flow restriction is such that the reservoir 46 is filled in about 15 seconds at a pressure differential across the orifice of about 30 psi.

Figure 4:
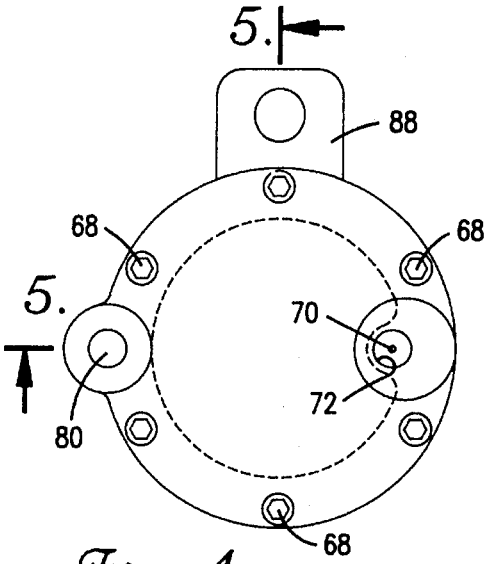
FIG. 4 is a top plan view of another embodiment of the device of the present invention.
Figure 5:
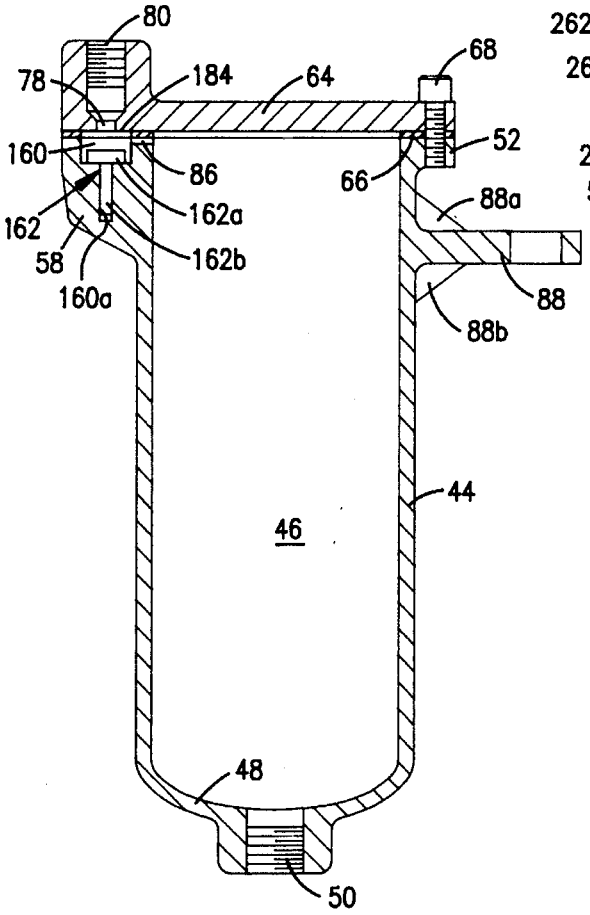
FIG. 5 is a sectional view taken generally along line 5—5 of FIG. 4 in the direction of the arrows.

FIGS. 4 and 5 depict an alternative embodiment of the container. In the embodiment of FIGS. 4 and 5, the parts that are similar to those in the embodiment of FIGS. 2 and 3 are identified by the same reference numerals used in FIGS. 2 and 3.

The embodiment of FIGS. 4 and 5 differs primarily in the configuration of the valve element. In place of the ball 62, the embodiment of FIGS. 4 and 5 includes a valve element 162 which takes the form of a discoidal valve head **162*a* located on top of a stem 162*b*. The valve chamber 160 is somewhat smaller than the valve chamber 60 and is flat at the bottom. A passage 160*a* extends downwardly from chamber 160 and closely receives the valve stem 162*b* to restrict the valve element 162 to vertical movement. The valve seat 184 is flat rather than being tapered as the valve seat 84, thus conforming with the flat configuration of the top of the valve head 162*a*. FIG. 5 depicts upper and lower gussets 88*a* and 88*b* which strengthen the connection of the mounting bracket 88** with the wall of the container.

The embodiment shown in FIGS. 4 and 5 operates in substantially the same manner as that described previously in connection with FIGS. 2 and 3. Under normal operating conditions, the valve element 162 is forced upwardly from the position shown in FIG. 5 and seats against the seat 184 in order to close the vent 78. However, when the pressure to which the reservoir 46 is exposed drops below 0 psig (or some other selected low pressure level), there is insufficient pressure differential across the valve head to maintain the valve element closed. Then, the valve element drops to the open position shown in FIG. 5, and the vent 78 operates in the manner described previously to allow air to flow into and out of the reservoir 46. When the pressure level again rises as the pump operates, the valve element 162 is forced upwardly against the seat 184 to close the vent 78.

Figure 6:
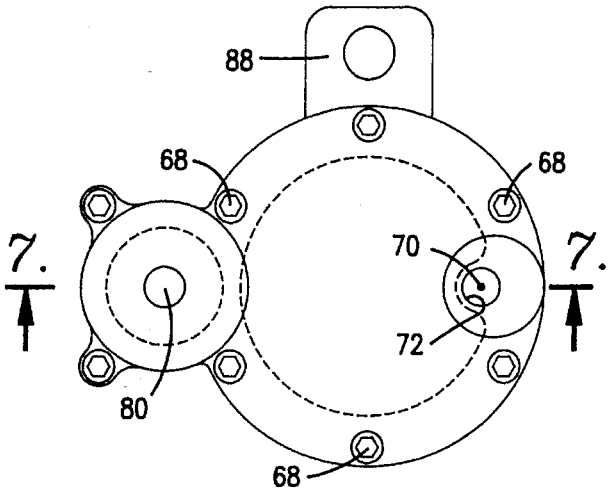
FIG. 6 is a top plan view of yet another embodiment of the device of the present invention.
Figure 7:
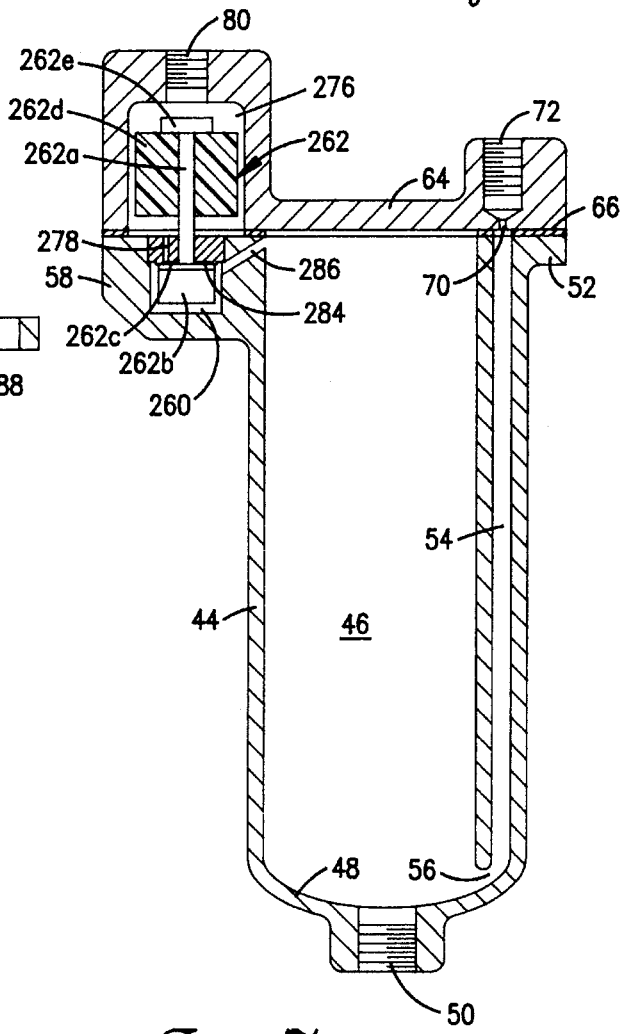
FIG. 7 is a sectional view taken generally along line 7—7 of FIG. 6 in the direction of the arrows.

FIGS. 6 and 7 depict a third embodiment of the container. Again, the parts that are similar to those described in connection with FIGS. 2 and 3 are identified by the same reference numerals used in FIGS. 2 and 3. Again, the principal difference in the embodiment shown in FIGS. 6 and 7 lies in the arrangement of the valve.

The embodiment of FIGS. 6 and 7 includes a valve element which is identified by numeral 262. The valve element 262 includes a vertical valve stem **262*a* which carries a foot 262*b* on its lower end. A gasket 262*c* is carried above the foot 262*b* and performs the sealing function of the valve element. The foot 262*b* and gasket 262*c* are located in a valve chamber 260 which connects with the reservoir 46 through an inclined passage 286 that opens into the reservoir at its extreme top end. A valve seat 284 is located in the boss 58 at the top of the valve chamber 260. A vent opening 278 is formed through the seat 264 and is sealed closed by the gasket 262*c* when the valve element is in the closed position shown in FIG. 7. A float 262*d* is carried on the stem 262*a* immediately below a head 262*e* formed on the top end of the stem. The float 262*d* can float upwardly and downwardly in a chamber 276 located in the lid 264 at a location overlying the valve seat 284. Passage 80 connects with the chamber 276**.

The embodiment shown in FIGS. 6 and 7 operates in generally the same manner described previously. The reservoir 46 is normally filled with fuel which flows through passage 286, valve chamber 260 and the vent 278 into chamber 276. The float **262*d* floats upwardly when fuel is in chamber 276, and this pulls gasket 262*c* upwardly to the closed position in which the vent 278** is closed.

When the pressure in the reservoir 46 drops to a relatively low level such as 0 psig, the float **262*d* drops, thus releasing the gasket 262*c* from its closed position against the seat 284. The vent 278 is then open to allow air to enter the reservoir as the fuel is displaced from the reservoir into the product line. When the pump is operated again to fill the reservoir 46, the float 262*d* floats upwardly again, and the gasket 262*c* closes the vent passage 278**.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In an apparatus having a fuel storage tank, a fuel dispenser, a product line which extends from the storage tank to the fuel dispenser and which is normally maintained at a normal operating pressure and a pump for pumping fuel from the tank to the dispenser, the improvement comprising:

a reservoir adapted to contain fuel, said reservoir having a liquid port connected with said product line and a vent connected with a low pressure below the normal operating pressure; and valve means for opening and closing said vent in response to the pressure applied to the reservoir through said liquid port, said valve means being arranged to maintain said vent closed at the normal operating pressure and to open said vent when the pressure in the reservoir drops to a predetermined level below the normal operating pressure, said valve means being arranged to close the vent again when the pressure in the reservoir rises to the normal operating pressure again.

2. Apparatus as set forth in claim 1, wherein said reservoir has a bottom and said liquid port is located adjacent to the bottom of the reservoir.

3. Apparatus as set forth in claim 2, including a siphon line connected between said liquid port and said product line.

4. Apparatus as set forth in claim 2, including an orifice connected between said liquid port and said product line.

5. Apparatus as set forth in claim 2, including:

a valve chamber in which said valve means operates;

a top of said reservoir; and a passage connecting said reservoir with said valve chamber, said passage being adjacent the top of the reservoir.

6. Apparatus as set forth in claim 1, wherein said valve means comprises:

a valve seat; and a valve element exposed to the pressure in the reservoir and arranged to seat on the valve seat to close said vent at the normal operating pressure and to unseat from the valve seat to open said vent when the pressure in the reservoir drops to said predetermined level.

7. Apparatus as set forth in claim 6, wherein said valve element comprises a ball member.

8. Apparatus as set forth in claim 6, wherein said valve element comprises a stem carrying a head thereon for seating on and unseating from the valve seat.

9. Apparatus as set forth in claim 3, including an orifice connected between said siphon line and said product line.

10. Apparatus as set forth in claim 9, including:

a valve chamber in which said valve means operates; and a passage connecting said reservoir with said valve chamber, said passage being located adjacent a top of the reservoir.

11. In a fuel dispensing system having a tank adapted to contain liquid fuel, a dispenser for dispensing the fuel, a product line extending from the tank to the dispenser and subject to losing liquid volume due to thermal contraction, a pump for pumping fuel through the product line at a normal operating pressure of the pump, and a leak detector in the product line for detecting fuel leakage therefrom, the improvement comprising:

a substantially fluid tight reservoir adapted to contain fuel in an amount sufficient to make up for thermally induced fuel contraction in the product line;

a siphon line opening into said reservoir and connected with the product line to subject the reservoir to a pressure substantially the same as the product line pressure;

a vent opening into said reservoir and connected with a low pressure lower than said normal operating pressure of the pump; and a valve element responsive to the pressure in said reservoir, said valve element being arranged to close said vent at said normal operating pressure of the pump and to open said vent when the pressure in the reservoir drops to a predetermined level below the normal operating pressure, thereby allowing the fuel in the reservoir to flow into the product line to make up the liquid volume lost due to thermal contraction.

12. The improvement of claim 11, wherein:

said reservoir has top and bottom ends; and said siphon line opens into the reservoir at a location adjacent the bottom end thereof.

13. The improvement of claim 11, including an orifice connected between said siphon tube and product line.

14. Apparatus as set forth in claim 11, wherein said valve element comprises a ball member.

15. Apparatus as set forth in claim 11, wherein said valve element comprises a stem carrying a head thereon for opening and closing said vent.

16. Apparatus as set forth in claim 11, wherein said valve element includes a float responsive to the liquid level in the reservoir.

17. The improvement of claim 12, including:

a valve chamber in which said valve element operates; and a passage extending between said reservoir and valve chamber at a location adjacent the top end of the reservoir.

18. The improvement of claim 17, including an orifice connected between said siphon tube and product line.

19. A method of compensating for thermally induced volume loss of a liquid fuel pumped from a storage tank to a dispenser through a product line which is normally maintained at a normal operating pressure, said method comprising the steps of:

supplying the fuel to a substantially fluid tight container in an amount sufficient to make up the volume loss of the liquid in the product line due to thermal contraction;

connecting the container with the product line to allow the fuel to flow therebetween;

maintaining the container in an unvented condition when the pressure in the product line ms at or above the normal operating pressure; and venting the container when the pressure in the product line drops to a predetermined low level below the normal operating pressure, thereby allowing the fuel in the container to flow into the product line to make up the thermally induced liquid volume lost therein due to thermally induced contraction of the fuel in the product line.

* * * * *